US008869397B2

(12) United States Patent
Dunleavy et al.

(10) Patent No.: US 8,869,397 B2
(45) Date of Patent: Oct. 28, 2014

(54) METHOD OF FABRICATING A METAL PART INCLUDING FIBROUS ANNULAR REINFORCEMENT

(75) Inventors: Patrick Dunleavy, Palaiseau (FR); Jean-Michel Patrick Maurice Franchet, Paris (FR); Gilles Charles Casimir Klein, Mery sur Oise (FR); Richard Masson, Buc (FR)

(73) Assignee: Messier-Bugatti-Dowty, Velizy villacoublay (FR)

( * ) Notice: Subject to any disclaimer, the term of this patent is extended or adjusted under 35 U.S.C. 154(b) by 353 days.

(21) Appl. No.: 13/378,815

(22) PCT Filed: Jun. 14, 2010

(86) PCT No.: PCT/FR2010/051179

§ 371 (c)(1), (2), (4) Date: Jan. 31, 2012

(87) PCT Pub. No.: WO2010/146293

PCT Pub. Date: Dec. 23, 2010

(65) Prior Publication Data

US 2012/0124838 A1 May 24, 2012

(30) Foreign Application Priority Data

Jun. 16, 2009 (FR) ..... 09 54029

(51) Int. Cl.

| | |
|---|---|
| ***B21D 53/78*** | (2006.01) |
| ***B21K 3/04*** | (2006.01) |
| ***B23P 15/02*** | (2006.01) |
| ***C22C 47/06*** | (2006.01) |
| ***C22C 47/04*** | (2006.01) |
| ***C22C 14/00*** | (2006.01) |

(52) U.S. Cl.

CPC ..... *C22C 14/00* (2013.01); *C22C 47/064* (2013.01); *C22C 47/04* (2013.01)

USPC ..... 29/889.71; 29/889.7; 29/889.2; 29/419.1; 228/121; 228/190; 228/235.1; 416/230

(58) Field of Classification Search

CPC ..... B21C 37/047; C22C 47/00; B23P 15/04; F01D 5/282; Y02T 50/672

USPC ..... 29/419.1, 889.71, 889.7, 889.2; 228/121, 190, 235.1, 194; 416/230, 416/241 R

See application file for complete search history.

(56) References Cited

U.S. PATENT DOCUMENTS 3,828,417 A * 8/1974 Divecha ..... 29/419.1
4,867,644 A * 9/1989 Wright et al. ..... 416/230

(Continued)

FOREIGN PATENT DOCUMENTS

CA 2 409 791 A1 4/2003
CN 1868627 A 11/2006

(Continued)

OTHER PUBLICATIONS

International Search Report Issued Sep. 17, 2010 in PCT/FR10/51179 Filed Jun. 14, 2010.

(Continued)

*Primary Examiner* — Richard Chang
(74) *Attorney, Agent, or Firm* — Oblon, Spivak, McClelland, Maier & Neustadt, L.L.P.

(57) ABSTRACT

A method reinforcing an axisymmetric annular metal part by including a winding of composite material. A metal blank for the part is prepared, a cavity is formed therein that opens out into a coaxial inside face thereof, and that presents a right cross-section of axial extent that decreases from the inside towards the outside, a reinforcing yarn is wound in the cavity, the cavity is closed, the assembly is subjected to a hot isostatic compression process, and the blank is machined to obtain a final part.

7 Claims, 3 Drawing Sheets

(56) References Cited

U.S. PATENT DOCUMENTS

| | | | | |
|---|---|---|---|---|
| 7,325,306 | B2 | 2/2008 | Twigg | |
| 7,516,548 | B2 * | 4/2009 | Twigg | 29/889.71 |
| 2007/0051455 | A1 | 3/2007 | Franchet et al. | |
| 2011/0099791 | A1 | 5/2011 | Dunleavy et al. | |
| 2011/0107579 | A1 | 5/2011 | Dunleavy et al. | |

FOREIGN PATENT DOCUMENTS

| | | | |
|---|---|---|---|
| CN | 1931463 | A | 3/2007 |
| CN | 101415541 | A | 4/2009 |
| DE | 10 2004 001 262 | | 8/2005 |
| FR | 2 886 290 | | 12/2006 |
| FR | 2 919 283 | A1 | 1/2009 |

OTHER PUBLICATIONS

Combined Office Action and Search Report issued Mar. 4, 2013 in Chinese Patent Application No. 201080027205.9 (English translation only).

* cited by examiner

METHOD OF FABRICATING A METAL PART INCLUDING FIBROUS ANNULAR REINFORCEMENT

BACKGROUND OF THE INVENTION

1. Field of the Invention

The invention relates to a metal part presenting an annular portion containing fibrous coaxial annular reinforcement in the form of a winding of composite material embedded in a metal matrix. More particularly, the invention relates to fabricating such a part that benefits from improved strength. The invention also provides a metal part containing such coaxial annular reinforcement.

2. Description of the Related Art

It is known to reduce the weight of an annular metal part while ensuring that it presents very great strength in tangential compression or traction, by incorporating fibers of composite material, such as ceramic fibers for example, in the mass of metal. By way of example, the ceramic may be a yarn of silicon carbide presenting compression or traction strength that is greater than that of a metal, such as titanium for example.

In order to obtain such a part, it is possible to wind a yarn of metal-coated ceramic inside a blank for the part. For example, document FR 2 886 290 proposes making the winding directly on a portion of the blank that acts as a winding mandrel. That is entirely conventional "external" winding. More precisely, that portion comprises two shoulders. The radially-inner shoulder forms a lateral bearing surface for winding. The adjacent cylindrical portion forms the base surface on which the winding is made. In right cross-section, the winding is rectangular in shape. After winding, the blank has additional metal portions applied thereto, in particular an outer ring and a lateral cover presenting a tenon that comes into contact with the winding. The assembly is then subjected to a step of hot isostatic compression during which the cover in particular is deformed so that the winding is compressed by the tenon. The operation of hot isostatic compression is itself known; it consists of placing the above-mentioned assembly in a box and in subjecting the assembly for several hours to a high pressure of the order of 1000 bar and to a temperature of the order of 1000° C. After this operation, the part, now in the form of a single block, is machined to have the desired shape and dimensions. Generally, the various portions of the blank and the sheath of the ceramic yarn are made of the same metal so that the finished part is provided with a wound composite insert that is embedded in a uniform metal matrix.

The zone that is reinforced by the winding is generally rectangular in right cross-section. In order to reduce the weight of the part and increase its traction/compression strength in the tangential direction, it is desirable for the reinforced zone that is surrounded by portions made exclusively of metal to occupy a volume that is as large as possible.

This arrangement with an insert of rectangular right section cannot be completely satisfactory depending on the direction of the forces that are applied to the part. Although the strength of the fibers is excellent tangentially, both in traction and in compression, it is less than the strength of the pure metal when forces are applied in a direction that extends across the fibers. As examples, this applies in particular when the annular part as fabricated in this way is a rotary part fitted with blades, such as a turbine disk, in particular for an airplane turbojet. Another part that is subjected to transverse forces is the "rotary sleeve" that is connected to the actuators in a landing gear mechanism.

With a part having a winding of rectangular right cross-section, it is possible for breakage to occur in the outside portion of the reinforced zone.

BRIEF SUMMARY OF THE INVENTION

The invention is based on the idea of establishing a "progressive" zone of pure metal in said outside radial region, laterally between the periphery and the zone containing the turns. According to the invention, this leads to shaping the winding in such a manner that it presents a right cross-section of axial extent that decreases radially going outwards, at least in a radially outer zone of the axisymmetric part.

For example, a wound portion of right cross-section that is trapezoidal or triangular, at least in its radially outermost part, is suitable for satisfying the requirements of the problem. It is also possible to envisage a half-wave shape, as long as the proportion of pure metal increases radially going towards the outside of the part, other things remaining equal.

Another difficulty is then how to make the part, since the above-described "external" winding is difficult to envisage. The invention also proposes a novel approach to such winding, referred to as "internal" winding.

More precisely, the present invention provides a method of fabricating an axisymmetric annular metal part reinforced by including coaxial annular reinforcement therein in the form of a winding of composite material, the method being characterized by the steps consisting in:

- preparing an annular metal blank for said part;
- making or finishing off a cavity that opens out into a coaxial inside face of said blank and that possesses a right cross-section of axial extent that decreases going radially outwards over at least a portion of its height;
- winding a reinforcing yarn in said cavity so as to fill substantially all of the space therein with a winding,
- closing said cavity with a metal wall part;
- subjecting the assembly to a hot isostatic compression process; and
- machining said blank to obtain the final shape of said part.

The term "right cross-section" is used to designate a section in a plane containing the axis of the axisymmetric part under consideration, and more precisely the axis of the blank in the above definition.

According to an advantageous characteristic, the reinforcing yarn is constituted by a ceramic core that is sheathed in metal.

The shape of the winding as obtained in this way, i.e., essentially the shape of the zone containing ceramic fibers, makes it possible to reserve radially towards the outside of said zone and on either side thereof larger masses of pure metal (e.g. titanium), thereby enabling an essentially radial force to become transferred "progressively" into the fibers in directions that transform the force more and more into a force that is oriented tangentially.

It is possible to stabilize the winding that is being made by welds that bond together certain turns via their metal sheaths.

In order to perform the so-called "internal" winding, the winding of the reinforcing yarn is begun by fastening an end of the yarn to the bottom of the cavity and winding is continued by causing the blank to turn about its axis while feeding the yarn at a speed that is controlled relative to the speed of rotation of the blank.

Advantageously, the yarn is fed at a speed such as to cause it to apply a force on said blank in its direction of rotation.

BRIEF DESCRIPTION OF THE SEVERAL VIEWS OF THE DRAWINGS

The invention can be better understood and other advantages thereof appear more clearly in the light of the following description illustrating a method of fabricating an axisymmetric annular metal part that is reinforced by a coaxial winding, the method being given purely by way of example and being described with reference to the accompanying drawings, in which.

DETAILED DESCRIPTION OF THE INVENTION

Figure 1:
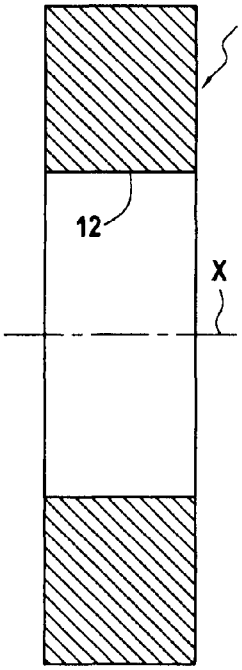
FIGS. 1, 2, 3A and 4 to 6 are right cross-section views of various steps in the method of fabricating an axisymmetric annular metal part that is reinforced by winding a reinforcing yarn.

With reference to the drawings, there follows a description of a method enabling an annular part such as a rotor disk to be made from a metal blank 11, e.g. made of titanium, itself of annular and axisymmetric shape, and having a rectangular right cross-section as shown in FIG. 1. The axis of revolution of the blank is referenced X.

Naturally, this section may have a different shape depending on the shape that it is desired to obtain for the final part.

The blank has a coaxial inside face 12, which face is cylindrical in this example.

The idea is both to lighten the final part and also to give it increased mechanical strength.

Figure 2:
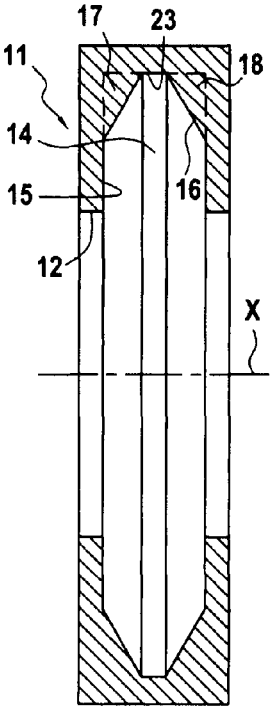

After such a blank has been prepared, the following step (FIG. 2) consists in forming an open cavity 14 in the mass of the blank, e.g. by machining, which cavity opens out into said coaxial inside face 12. By way of example, the blank may be caused to turn about the axis and a cutting tool may be inserted via the accessible central portion of said blank. Material is removed until an annular cavity is obtained that opens out into said coaxial inside face of the blank. It should be observed that it is also possible to start from a blank that is already hollow, and the machining operation could then consist merely in finishing off the cavity so as to give it the desired shape and dimensions.

According to an important characteristic, the cavity 14 presents a right cross-section of axial extent that decreases radially going outwards over at least a portion of its height. In the example shown, the cavity presents (in right cross-section and in a radial direction from the inside towards the outside) a rectangular shape 15 that is extended by a trapezoidal shape 16. This second portion of the cavity may be triangular in shape or may have any other shape in which its axial extent (parallel to the axis X) decreases going from the inside towards the outside.

This leads to a reserve of pure metal in the lateral zones 17 and 18 that are marked using dashed lines, compared with what would be obtained if the cavity presented a right cross-section that is rectangular.

Figure 3A:
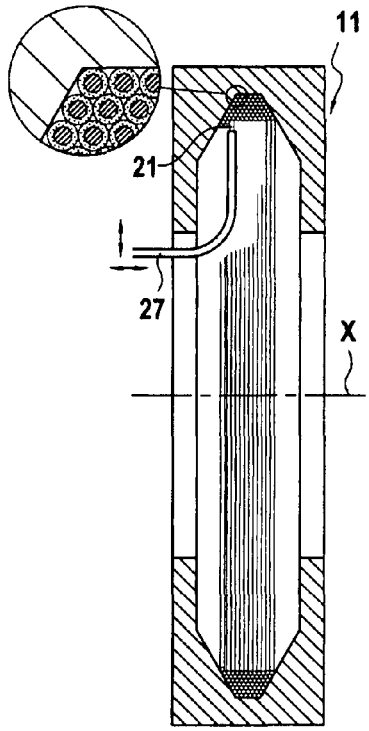

The following operation consists in winding a reinforcing yarn 21 in situ, here a ceramic yarn (silicon carbide) coated in metal. The metal is titanium, i.e. the same metal as that which constitutes the blank. This operation, as shown in FIG. 3A, is performed by inserting the yarn via the opening in the cavity and in laying the yarn starting from the cylindrical bottom 23 of the cavity in adjacent turns and then in successive layers of turns until the entire space of the cavity has been filled with a winding of touching turns 25.

Figure 3B:
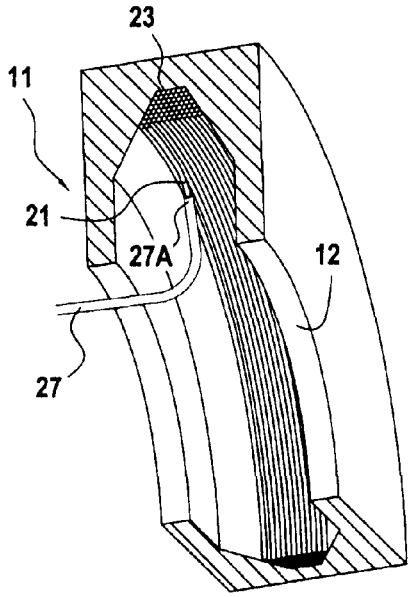
FIG. 3B is a fragmentary view in perspective showing the stage of FIG. 3A.

For winding purposes, it is possible to proceed as follows. The yarn is fed via a rigid tubular guide 27 that is movable in controlled manner parallel to the axis X (in order to form a layer) and radially inwards (in order to make the following successive layers). The guide 27 is pointed as shown in FIGS. 3A and 3B, i.e. its end 27A is at a small angle relative to the circumferential direction in which the turns are wound.

The winding of the yarn 21 is begun by fastening (by welding) one end of the yarn to the cylindrical bottom wall 23 of the cavity, close to an axial end thereof, and by causing the blank 11 to rotate about its axis X, with the yarn being fed at a speed that is controlled relative to the speed of rotation of the blank. By way of example, the speed at which the yarn 21 is delivered may be adjusted continuously so that its speed is always substantially equal to the winding speed, given the speed of rotation of the blank and the diameter of the layer of turns that is being wound.

Provision may also be made for the speed at which the yarn is fed to be such that it applies force to the blank in its direction of rotation. For example, the yarn 21 may be pushed inside the guide 27 by a drive system having motor-driven rotary wheels (not shown) that are capable of accommodating longitudinal slip in such a manner that said yarn is slightly compressed at its outlet from the guide 27 and the point where it takes up its position in the winding. It is even possible to envisage the blank 11 being mounted to rotate freely and that it is the force exerted on the yarn itself that serves to drive the blank in rotation during winding.

In order to avoid the winding expanding, the turns are stabilized at given intervals during winding by means of points or lines of welding to join together the metallic sheaths of some of the turns.

In known manner, the welding may be electric arc welding or induction welding, in a vacuum or in an inert atmosphere of argon. It is possible to use a welding process as described in FR 2 886 290.

Figure 4:
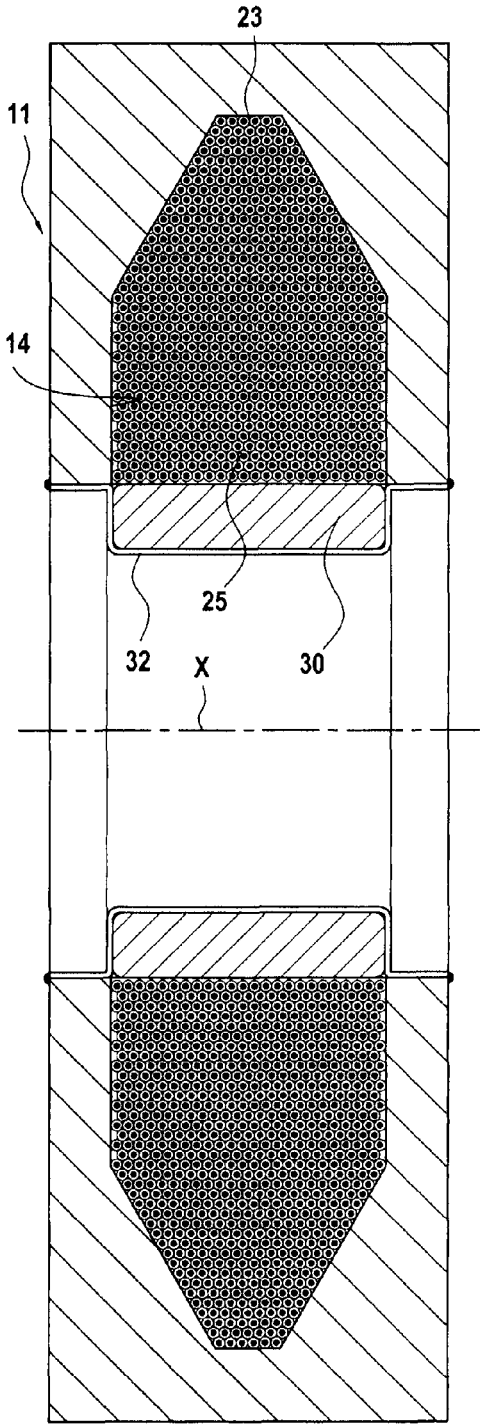

The following operation, FIG. 4, consists in closing the cavity 14 that has been filled with the winding 25. For example, a metal cylindrical annular wall 30 is put into place, here a titanium wall, in register with the opening of the cavity. This wall has the same axial extent as the opening so that when hot isostatic compression is applied, it is capable of penetrating into the cavity by deforming radially outwards, while simultaneously compacting the winding itself. The cylindrical annular wall 30 may be dimensioned in such a manner that its diameter is slightly greater than the diameter of the central opening of the blank, with the annular wall being cooled to a low temperature before being put into place (e.g. by being immersed in liquid nitrogen). Thus, even before the beginning of the hot isostatic compression operation, the annular wall 30 engages in the cavity and begins to compact the winding.

Advantageously, the closing of said cavity includes evacuating it and sealing it hermetically with a welded metal foil 32. This metal foil is welded on either side of the opening of the cavity, before the hot isostatic compression operation.

Thereafter, the hot isostatic compression operation proper is performed, e.g. by placing the blank, modified as shown in FIG. 4, in a box for several hours while raising the pressure to 1000 bar and the temperature to about 1000° C.

Figure 5:
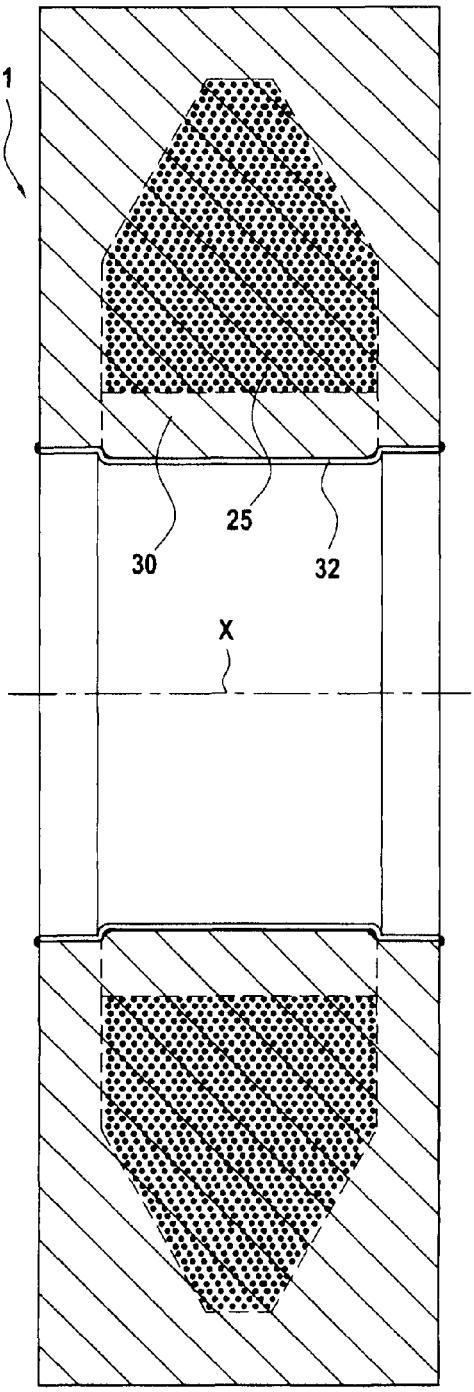

The result is shown in FIG. 5. It can be seen that the annular wall 30 has engaged in the cavity, taking the metal foil 32 with it. The assembly now forms a single block with a large portion of its volume occupied by a high-strength ceramic yarn winding that is embedded in a metal matrix that results from melting the metal sheath of the yarn that was used during the winding.

Figure 6:
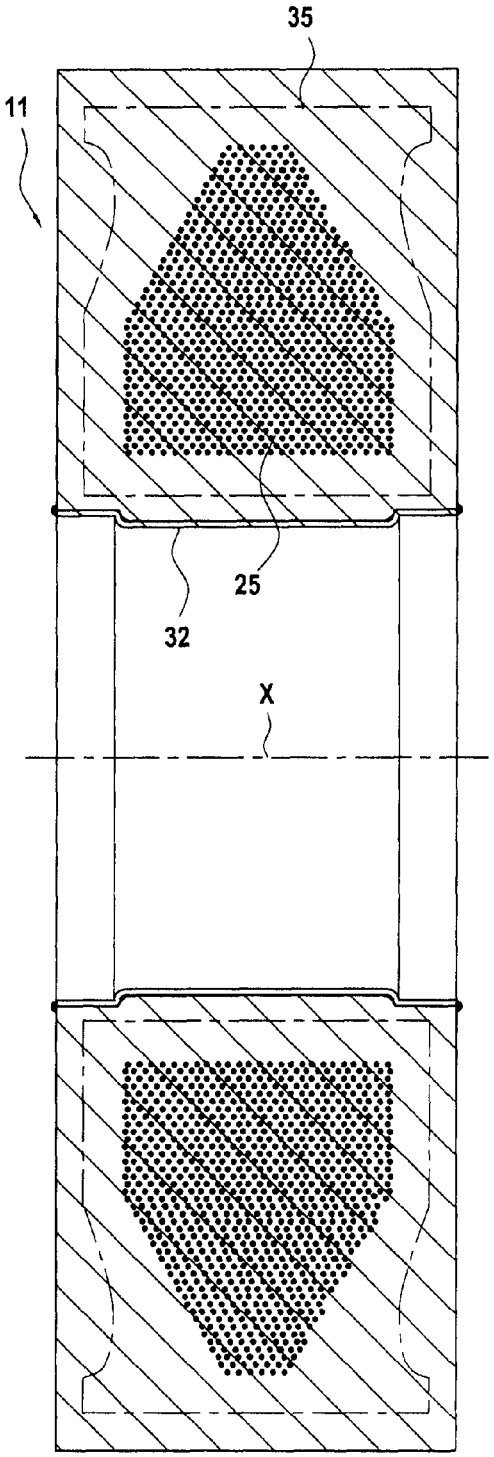
Figure 7:
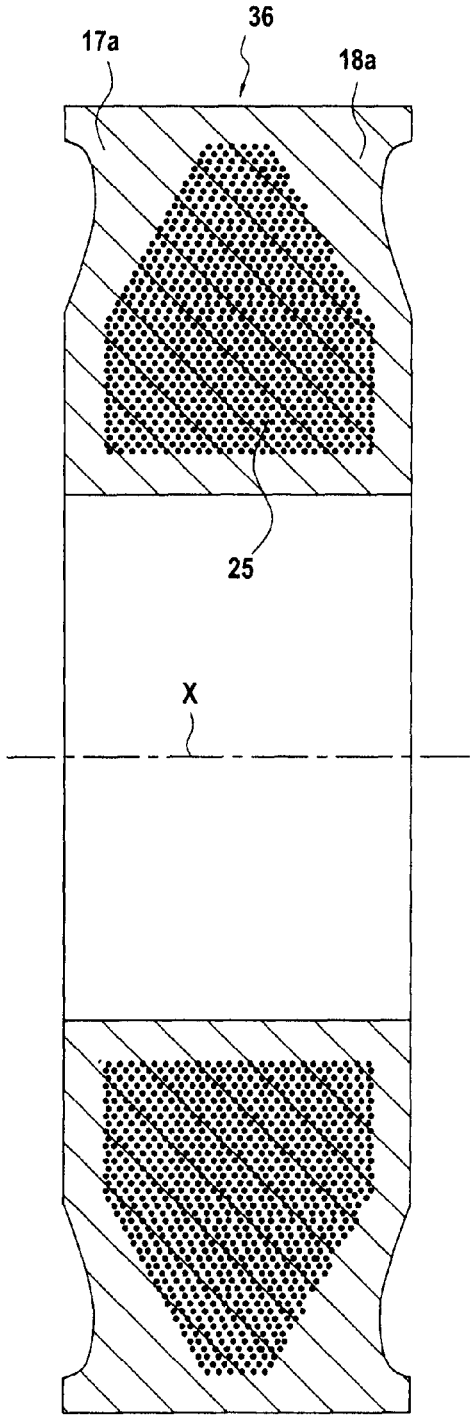
FIG. 7 shows the part as obtained in this way.

A series of machining operations (FIG. 6) are then performed for the purpose of converting the blank as transformed by the hot isostatic compression operation so as to define the outline 35 of the desired part (shown in chain-dotted lines in FIG. 6). The final part 36 as shown in FIG. 7 includes purely metallic outside lateral zones (17*a*, 18*a*) that enable the transverse mechanical strength of the part to be increased while locally limiting stiffness discontinuities that would encourage breaking. These "progressive" zones have the effect of causing forces to enter progressively by shear into the fiber reinforcement (the winding) so as to convert the forces into circumferential traction/compression for which the strength of the zone with the winding is optimized.

The invention claimed is:

1. A method of fabricating an axisymmetric annular metal part reinforced by including coaxial annular reinforcement therein in a form of a winding of composite material, the method comprising:

preparing an annular metal blank for the part;

making or finishing off a cavity that opens out into a coaxial inside face of the blank and that possesses a right cross-section of axial extent that decreases going radially outwards over at least a portion of a height thereof;

winding a reinforcing yarn in the cavity so as to fill substantially all of a space therein with a winding;

closing the cavity by putting into place a metal cylindrical wall in register with an opening of the cavity so as to present an assembly; then subjecting the assembly to a hot isostatic compression process; and machining the blank to obtain a final shape of the part.

2. The method according to claim 1, wherein the reinforcing yarn includes a core of composite material or of ceramic, sheathed in metal, and the winding that is being formed is stabilized by welds bonding together certain turns via the metal sheaths.

3. The method according to claim 1, wherein the winding of the reinforcing yarn is started by fixing one end thereof to a bottom of the cavity, and winding is continued by causing the blank to turn about an axis thereof while feeding the yarn at a speed that is controlled relative to a speed of rotation of the blank.

4. The method according to claim 3, wherein the yarn is fed at a speed that is such that a force is applied on the blank in a direction of rotation thereof.

5. The method according to claim 1, wherein the open cavity is shaped to give it a cross-section that is triangular or trapezoidal at least in part, at least in the radially outermost portion thereof.

6. The method according to claim 1, wherein the closing the cavity includes evacuating the cavity and hermetically closing the cavity with a metal foil that is welded on either side of the opening in the cavity, prior to performing the hot isostatic compression process.

7. The method according to claim 1, wherein the metal cylindrical wall has the same axial extent as the opening so that when the hot isostatic compression is applied, the metal cylindrical wall is capable of penetrating into the cavity by deforming radially outward, while simultaneously compacting the winding itself.

* * * * *